US006347565B2

(12) United States Patent
Steinweg

(10) Patent No.: US 6,347,565 B2
(45) Date of Patent: Feb. 19, 2002

(54) MULTI-DRIVE SPECIALTY TOOL

(75) Inventor: Paul Steven Steinweg, Lititz, PA (US)

(73) Assignee: Hand Held Design Corporation, Wilmington, DE (US)

( * ) Notice: Subject to any disclaimer, the term of this patent is extended or adjusted under 35 U.S.C. 154(b) by 0 days.

(21) Appl. No.: 09/480,787

(22) Filed: Jan. 10, 2000

Related U.S. Application Data

(60) Provisional application No. 60/115,368, filed on Jan. 11, 1999.

(51) Int. Cl.[7] ..... B25B 7/14

(52) U.S. Cl. ..... 81/319; 81/338

(58) Field of Search ..... 81/318–325, 332, 81/336, 337, 338, 177.2

(56) References Cited

U.S. PATENT DOCUMENTS

| | | | | |
|---|---|---|---|---|
| 381,544 | A | | 4/1888 | Garvey |
| 1,194,547 | A | | 8/1916 | Rogers |
| 1,505,510 | A | | 8/1924 | Uhl |
| 1,556,755 | A | | 10/1925 | Burman |
| 1,561,833 | A | * | 11/1925 | Cruickshank ..... 81/337 |
| 1,565,210 | A | | 12/1925 | Seiber |
| 2,277,343 | A | | 3/1942 | Medved |
| 2,361,607 | A | | 10/1944 | Daniels |
| 2,606,471 | A | | 8/1952 | Kollweck |
| 2,704,471 | A | | 3/1955 | Hendrickson |
| 3,013,456 | A | * | 12/1961 | Ericson ..... 81/319 X |
| 3,132,550 | A | | 5/1964 | Sion |
| 3,534,641 | A | | 10/1970 | Le Due |
| 4,070,932 | A | * | 1/1978 | Jeannotte ..... 81/177.2 |
| 4,162,640 | A | | 7/1979 | Arnold |
| 4,269,089 | A | | 5/1981 | Hastings |
| 4,438,669 | A | | 3/1984 | Hastings et al. |
| 4,466,437 | A | * | 8/1984 | Dyck et al. ..... 81/338 X |
| 4,813,310 | A | | 3/1989 | Moynihan |
| 4,896,661 | A | | 1/1990 | Bogert et al. |
| 5,052,252 | A | * | 10/1991 | Szymber et al. ..... 81/324 X |
| 5,392,673 | A | * | 2/1995 | Scott ..... 81/177.2 |
| 5,542,167 | A | | 8/1996 | Nakamoto |

FOREIGN PATENT DOCUMENTS

| | | | | |
|---|---|---|---|---|
| GB | 1295972 | * | 11/1972 | ..... 81/338 |

* cited by examiner

*Primary Examiner*—James G. Smith
(74) *Attorney, Agent, or Firm*—Leonard Bloom

(57) ABSTRACT

A specialty tool having removable and interchangeable jaw members which are secured to the handles by twist locking. A ratchet gear and pawl are disposed at the pivot hub of the tool to lock the tool in a selected position. A releasing lever provides an option to the user to use the ratcheting action.

14 Claims, 7 Drawing Sheets

MULTI-DRIVE SPECIALTY TOOL

CROSS REFERENCE TO RELATED APPLICATIONS

The present invention is related to Provisional Patent Application No. 60/115,368, filed Jan. 11, 1999.

FIELD OF THE INVENTION

The present application relates to a specialty tool and more particularly to a pair of pliers which can ratchet to a selected locked position and which have removable jaws.

BACKGROUND OF THE INVENTION

In the use of a pair of pliers, it is frequently found that the jaws do not adequately engage the workpiece because of the shape and configuration of the workpiece or because of the material of construction of the workpiece. For example, the workpiece may have faces which are at acute or obtuse angles to each other which are gripped only with difficulty by pliers having unangled jaws. The workpiece may have arcuate faces and the plier jaws are substantially non-arcuate so that the contact between the plier jaws and the faces of the workpiece is minimal and transmission of force between the pliers and the workpiece is insufficient. Alternately because of the mismatch of the plier jaws with the workpiece, the face of the workpiece is damaged. Workpieces covered with a resilient or foam coating are not gripped well by the jaws of the pliers.

The use of removable jaws on pliers and wrenches is known. Garvey, in U.S. Pat. No. 381,544, discloses soldering-pliers wherein the jaws have a small shank of uniform size and correspond to the socket formed in the end of each of the pivoted levers. When the set screws are removed, then the jaws also may be removed.

Rogers, in U.S. Pat. No. 1,194,547, discloses blacksmith's tongs wherein the opposing jaws are each provided with dove-tailed recesses which receive jaw pieces. When the set screws are removed, then the respective jaw piece may be removed.

Uhl, in U.S. Pat. No. 1,505,510, discloses pliers with interchangeable jaws which are connected to the handles with slotted or bifurcated terminal arms. A tongue on the jaw is received in the slot and a throat in the jaw encompasses a pin on the arm to secure the jaw to the arm.

In U.S. Pat. No. 1,556,755, Burman discloses a pliers-type tool in which each removable jaw has a cylindrical member which is received in a cylindrical recess in a disc on the end of each handle portion.

In U.S. Pat. No. 2,606,471, Kollweck discloses pliers with interchangeable jaws. Each jaw has a foot portion which is received in a socket formed in an end portion of the respective handle. A pin retains the foot in the socket.

Sion in U.S. Pat. No. 3,132,550, discloses a combination stretching and squeezing pliers wherein a pair of jaws are plugged by means of stems into a pair of sockets.

In U.S. Pat. No. 4,813,310, Moynihan discloses pliers having interchangeable and replaceable jaws. Each shank of the pliers has an outwardly projecting stud which is received in a recess formed in the jaw. The respective jaw is retained on the stud by a latch mounted on the shank.

Nakamoto, in U.S. Pat. No. 5,542,167, discloses a device for attaching/detaching a shaft snap ring and a hole snap ring. The leading portions have a shaft which is received in a guide hole in the grasp levers and are held in place by a ball-like stopper.

There is a need for interchangeable and removable jaw members to easily fit on the handles of pliers. The prior art discloses removable, interchangeable jaws which are complex to change and are not economical to manufacture.

It is also desirable to have a specialty tool which, after grasping a workpiece, can be ratcheted to lock the specialty tool onto the workpiece without holding by the user and which locking means can be released by disengaging a pawl.

In U.S. Pat. No. 2,277,343, Medved discloses a wire bending, clinching, and cutting tool (not pliers) having a ratchet member.

In U.S. Pat. No. 4,162,640, Arnold discloses nose-clamp pliers for fastening a split annular hose clamp whose opposite ends are provided with ratchet teeth adapted for interlocking engagement. The ratcheting means are not a part of the pliers.

Also, the following U.S. Patents disclose adjustable jaw pliers which have a spring actuated dog or tooth to be received in a rack.

| U.S. Pat. No. | Inventor |
|---|---|
| 1,565,210 | Seiber |
| 2,361,607 | Daniels |
| 2,704,471 | Hendrickson |
| 3,534,641 | LeDuc |

All of these references disclose a rack formed on an elongated slot and the dog or tooth being adjustable along the rack.

Hastings, in U.S. Pat. Nos. 4,269,089 and 4,438,669, discloses adjustable ratchet pliers having ratchet means at the pivot of the two arms. A ratchet dog has a receptacle in which is disposed a spring and ratchet pin. The ratchet pin is opposite from the ratchet tooth and biases the tooth into engagement with one of a plurality of cavities in a slot in one of the arms.

In U.S. Pat. No. 4,896,661, Bogert et al disclose a multi-purpose orthopedic ratcheting forceps having readily interchangeable tip elements and a reversible ratchet mechanism. The jaw portions are sleeves with detent balls and springs which secure the tip which is inserted into the jaw portion. The ratchet mechanism is a curved ratchet tooth member connected to one of the arms of the forceps between the pivot pin and the opening to manually hold the forceps. The ratchet member passes through the pawl mechanism chamber. A pawl within the chamber is urged towards the teeth of the ratchet member by a spring-loaded ball.

There is a need for a specialty tool which is adaptable to multiple workpieces, can be ratcheted to lock on the workpiece and is less complex.

BRIEF SUMMARY OF THE INVENTION

It is an object of the present invention to provide a specialty tool which is used to grasp a workpiece, ratchet to a locked position at the option of the user and be easily released from the locked position.

It is a further object of the present invention to provide a specialty tool with removable jaws such that a plurality of jaws may be interchanged as needed for different types of workpieces.

In accordance with the teachings of the present invention, there is disclosed a specialty tool having interchangeable jaws having a ratcheting means for optional ratcheting locking of the jaws at the selection of the user and further having a releasing means connected to the ratcheting means.

In additional accordance with the teachings of the present invention, there is disclosed a specialty tool having a first handle and a second handle. A first jaw member is attached to the first handle and a second jaw member is attached to the second jaw handle. The handles are pivotally joined at a hub. A ratcheting means is formed at the hub, wherein the specialty tool has optional ratcheting locking of the jaws at the selection of the user.

In further accordance with the teachings of the present invention, there is disclosed a specialty tool having a first handle and a second handle. A first jaw member is removably attached to the first handle and a second jaw member is removably attached to the second handle. The handles are pivotably joined at a hub. A ratcheting means is formed at the hub wherein the specialty tool may be optionally ratcheted about the hub.

In another aspect, there is disclosed a specialty tool having a first handle and a second handle pivotably joined at a hub. Each handle has a respective stud extending outwardly from the hub. A pin is formed on each stud, the respective pins being perpendicular to a center line of each stud. A first jaw member and a second jaw member are provided, each jaw member having a respective first end and a respective second end. The first ends each have a work surface and the second ends each are an engagement tip. Each engagement tip has an axial bore formed therein. An L-shaped slot is formed in each axial bore, each L-shaped slot having a leg and a base. The base is disposed interiorly of the axial bore. The respective stud is received in the bore in the respective engagement tip with the pin received in the leg of the L-shaped slot. When the respective jaw member is twisted, the pin is received in the base of the L-shaped slot such that the respective jaw members are removably locked on the respective studs.

There is further disclosed a specialty tool having a pair of handles pivotally joined at a hub in a plier-like manner. The tool has replaceable jaws connected to the handles. A ratcheting means is disposed in the hub for optional ratcheting of the specialty tool. A releasing means is connected to the ratcheting means.

These and other objects of the present invention will become apparent from a reading of the following specification taken in conjunction with the enclosed drawings.

BRIEF DESCRIPTION OF THE DRAWINGS

FIG. 5 is a 45° hose clamp.

FIG. 6 is an extra long hose clamp.

FIG. 7 is a hose pinch-off.

FIG. 8 is a hose pull-off.

FIG. 9 is for piston ring tips.

FIG. 10 is for wiper arm removal.

FIG. 11 is a brake spring plier.

FIG. 12 is a Ford fuel line and air-conditioning quick disconnect.

FIG. 13 is for snap ring plier tip receptacles.

DESCRIPTION

Figure 1:
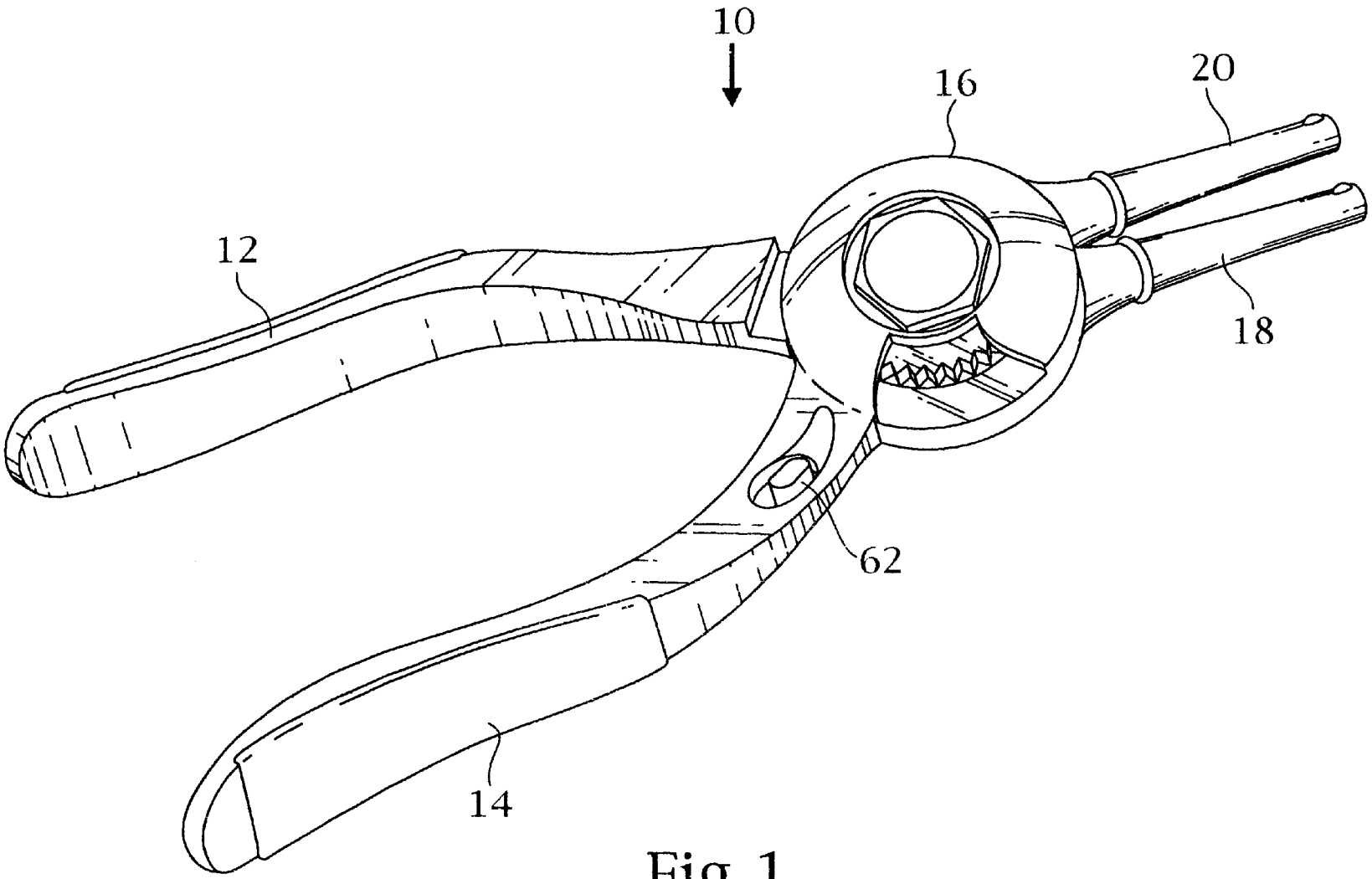
FIG. 1 is a perspective view of the specialty tool of the present invention with the jaw members removed to show the studs in the respective handles.
Figure 2:
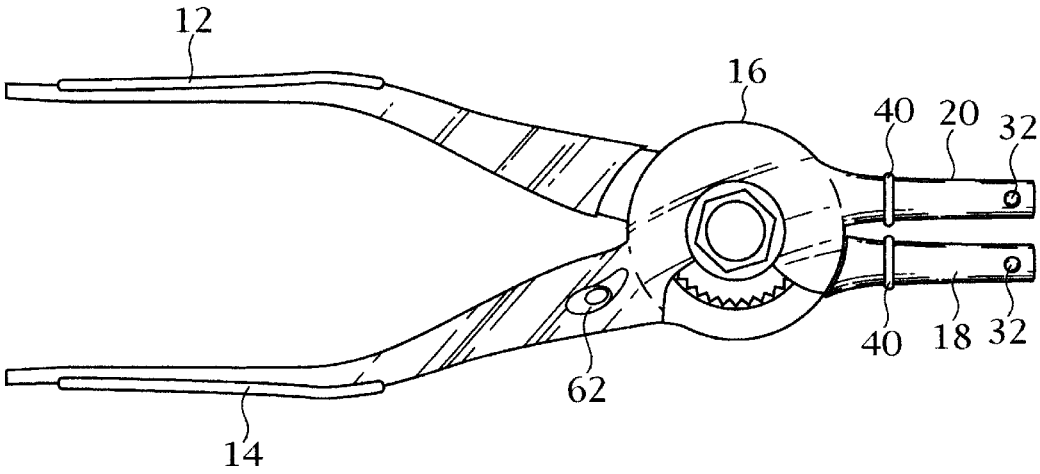
FIG. 2 is a top plan view of the specialty tool of the present invention with the jaw members removed.
Figure 3:
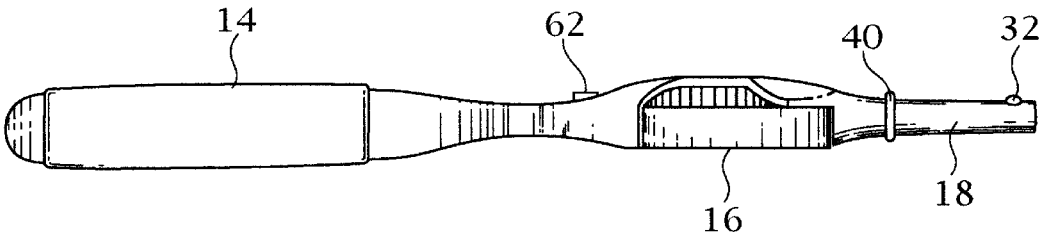
FIG. 3 is a side elevation view of the specialty tool of the present invention with the jaw members removed.
Figure 4:
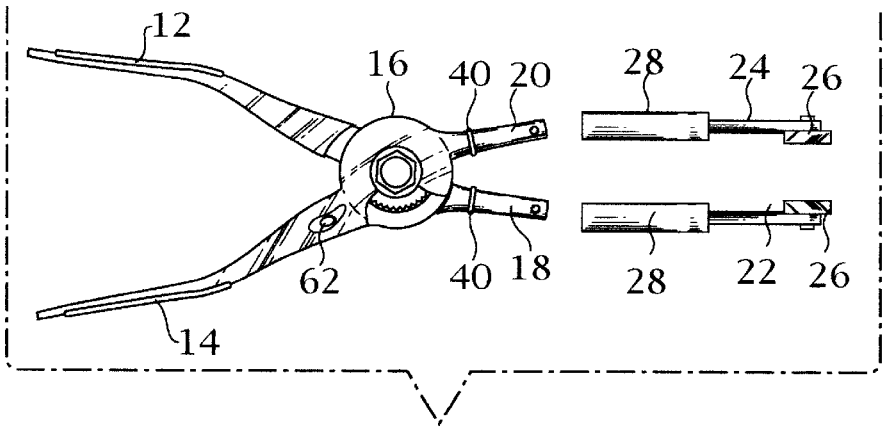
FIG. 4 is a top plan view showing the specialty tool being engaged with jaw members for a straight hose clamp.
Figure 5:
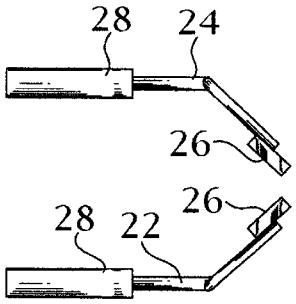
FIGS. 5–13 are top plan views of various types of jaw members which are removably received on the studs of the specialty tool.
Figure 10:
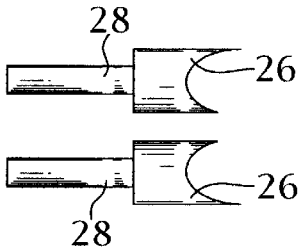
Figure 6:
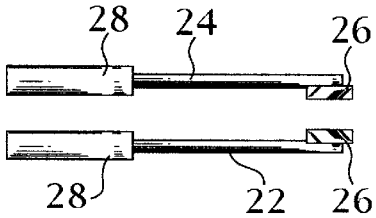

Referring now to FIGS. 1–19, the specialty tool 10 of the present invention have first handle 12 and a second handle 14. The handles 12, 14 are pivotally joined at a hub 16. Each handle 12, 14 continues on the opposite side of the hub 16 to form a respective first stud 18 and second stud 20, the studs being an integral part of the respective handles in a manner similar to a pair of pliers. The specialty tool 10 is pivoted to operate as conventional pliers in that moving the handles 12, 14 toward one another produces concomitant movement of the studs 18, 20 and moving the handles 12, 14 away from one another also moves the studs 18, 20 away from one another.

Figure 11:
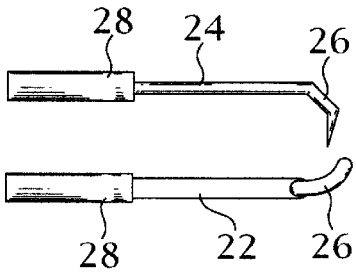
Figure 7:
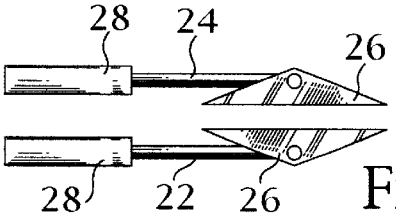
Figure 12:
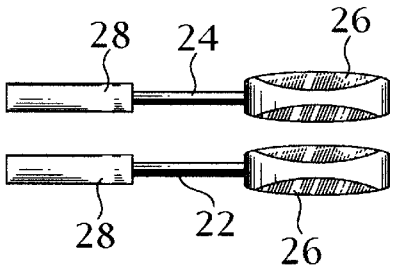
Figure 8:
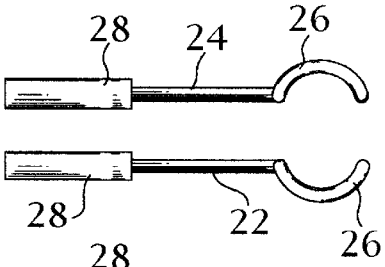
Figure 9:
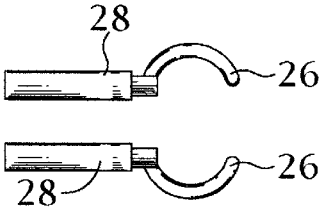
Figure 13:
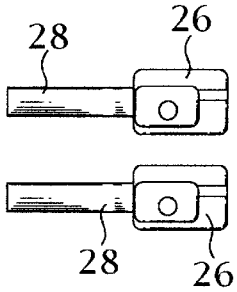

The specialty tool 10 also has removable and replaceable first jaw members 22 and second jaw members 24. Each jaw member 22, 24 has a first end and an opposite second end. The first ends each have a respective work surface 26. In many sets of jaw members, the work surface 26 of the first jaw member 22 is a mirror image of the work surface 26 of the second jaw member. The jaw members 22, 26 preferably are for specific function such as for use with: a straight hose clamp (FIG. 4), a 45° hose clamp (FIG. 5), an elongated hose clamp (FIG. 6), a hose pinch-off (FIG. 7), a hose pull-off (FIG. 8), for piston ring tips (FIG. 9), for wiper arm removal (FIG. 10), for Ford fuel line and air-conditioner quick disconnect (FIG. 12) and for snap ring plier tip receptacles (FIG. 13). The work surface 26 of the first jaw member 22 may be different from the work surface 26 of the second jaw member to form a jaw set such as for brake spring pliers (FIG. 11).

Thus, the present invention includes a plurality of removable jaw members 22, 24 defining a plurality of pairs of jaws, each respective pair of opposing jaw members being interchangeable and adapting the specialty tool for specified desired uses.

The examples shown in the figures are all directed to use with automobiles but the present invention is not limited to such use and may have jaw members usable with any workpiece which can be grasped with specialty tool.

Figure 14:
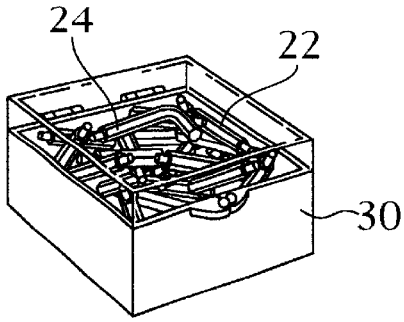
FIG. 14 is a perspective view of a container for the sets of interchangeable jaw members.
Figure 15:
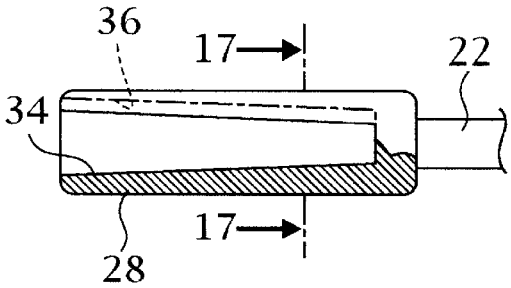
FIG. 15 is partial cross-sectional view of the engagement tip of a jaw member.
Figure 16:
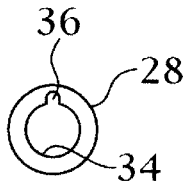
FIG. 16 is an end view of FIG. 15.
Figure 17:
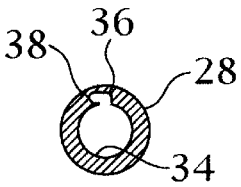
FIG. 17 is a cross-sectional view taken across the lines 17—17 of FIG. 15.
Figure 18:
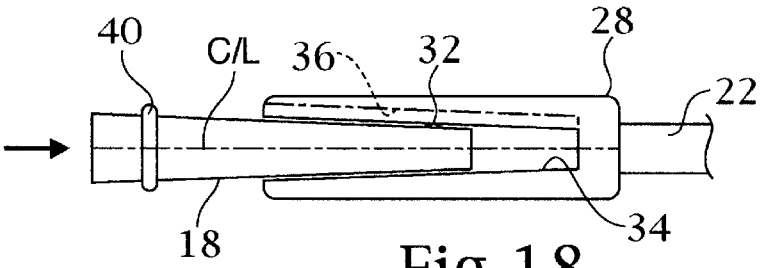
FIG. 18 is a side elevation view of the stud of one of the handles being received in the bore in the engagement tip of a jaw member.
Figure 19:
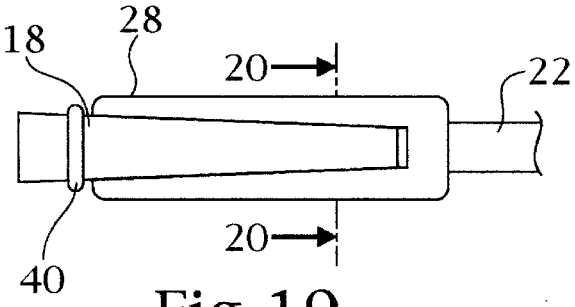
FIG. 19 is a side elevation view showing the engagement tip of the jaw member of FIG. 19 being twisted to lock the pin on the stud in the base of the L-shaped slot.
Figure 20:
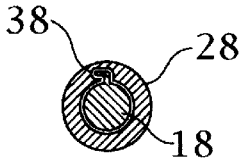
FIG. 20 is a cross-sectional view taken across the lines 20—20 of FIG. 19.

The sets of jaw members 22, 24 may be stored in a container 30 as shown in FIG. 14.

The jaw members 22, 24 are easily and quickly connected and disconnected from the respective studs 18, 20 (FIGS. 15–20). In a preferred embodiment, a pin 32 is formed in each stud 18, 20, the pins 32 being substantially perpendicular to a center line 42 of the respective stud 18, 20. Preferably, the pin 32 is disposed near the end of respective stud 18, 20. Each engagement tip 28 has an axial bore 34 formed therein which is configured to cooperate with and receive the respective stud 18, 20. In each axial bore 34, there is formed an L-shaped slot having a leg 36 and a base 38. The engagement tip 28 of the respective jaw member 22, 24 is slid over the respective stud 18, 20 so that the pin 32 on the stud is received and keyed in the leg 36 of the L-shaped slot. The stud 18, 20 is inserted fully into the bore 34 in the engagement tip 28 so that the pin 32 on the stud is aligned with the base 38 of the L-shaped slot and the respective jaw member 22, 24 is twisted in a first direction to receive the pin 32 in the base 38 of the L-shaped slot. This locks the respective jaw member 22, 24 onto the respective stud 18, 20. The same procedure is used with the matching jaw member 22, 24 of the set so that the pair of jaw members 22, 24 are secured on the respective studs 18, 20 and the specialty tool is ready for use with the selected jaw members. In order to remove the jaw members 22, 24, the respective jaw members 22, 24 are twisted in a second reverse direction to remove the pin 32 from the base 38 of the L-shaped slot. The jaw member 22, 24 is then withdrawn from the bore 34 in the engagement tip 28. The respective jaw members 22, 24 may be replaced with another set of jaw members 22, 24 for use with a different type of workpiece. The connecting means is not limited to the pin and slot but may use other connecting means known to persons skilled in the art.

It is further preferred that an elastomeric seal 40, such as an O-ring, be formed on each stud 18, 20 such that when the stud 18, 20 is received in the bore 34 in the engagement tip 28 and the jaw member 22, 24 is twist-locked in place, the elastomeric seal 40 contacts the end of the engagement tip distal from the work surface 26 of the haw member 22, 24. This contact reduces any wobble which may exist between the jaw member 22, 24 and the stud 18, 20.

Figure 21:
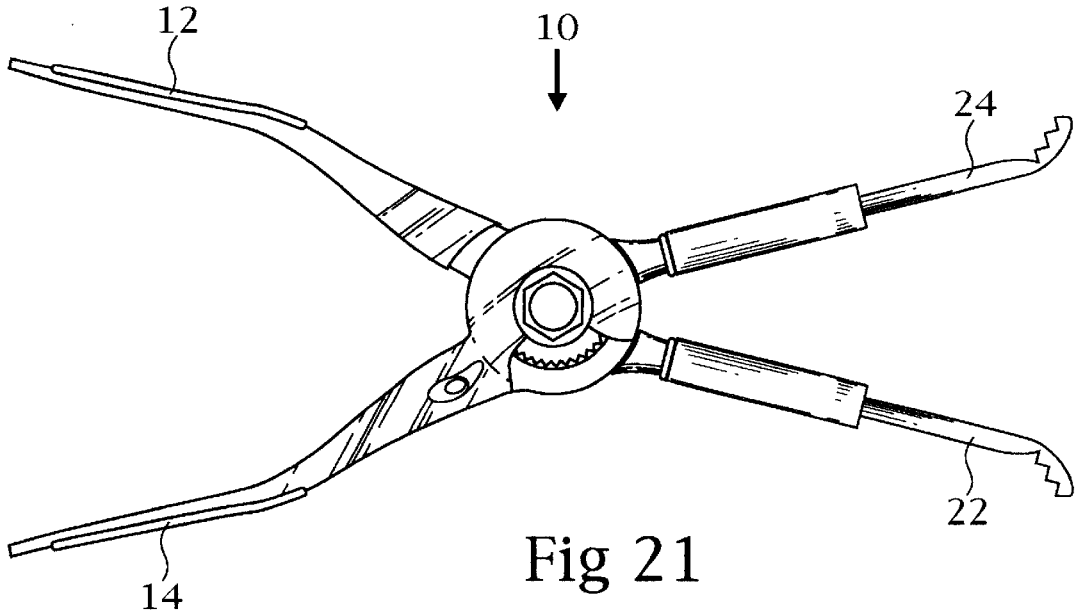
FIG. 21 is a top plan view showing the specialty tool used for internal grasping of a workpiece.
Figure 22:
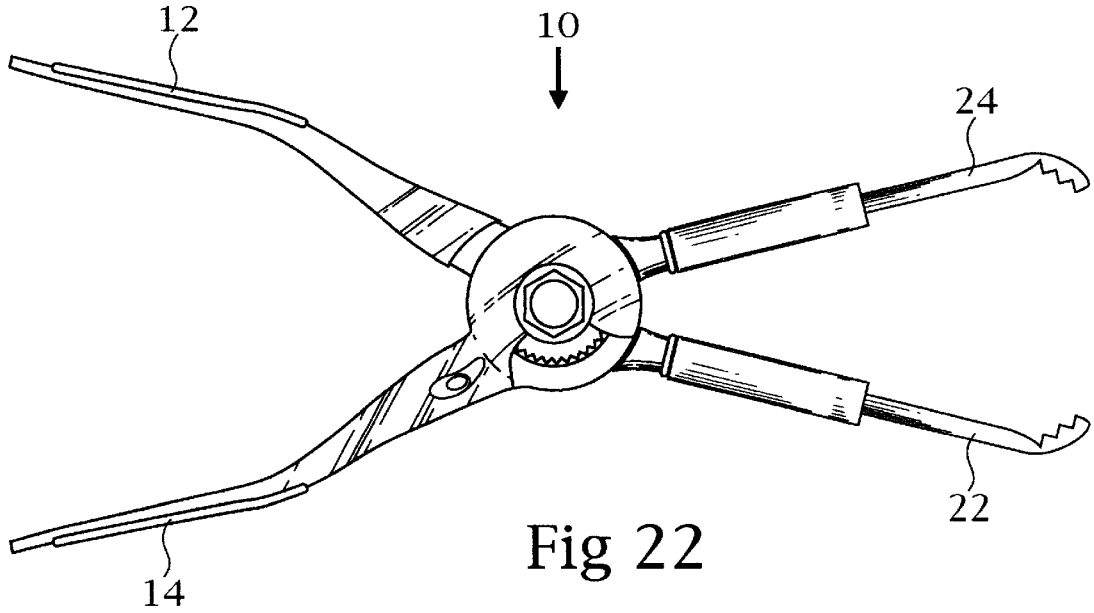
FIG. 22 is a top plan view showing the specialty tool used for external grasping of a workpiece.

The specialty tool 10 may have jaw members 22, 24 which can internally grasp a workpiece (FIG. 21) or may externally grasp a workpiece (FIG. 22). The use of the specialty tool with jaw members to remove or replace snap rings (FIG. 13) operates in a similar manner.

Figure 23:
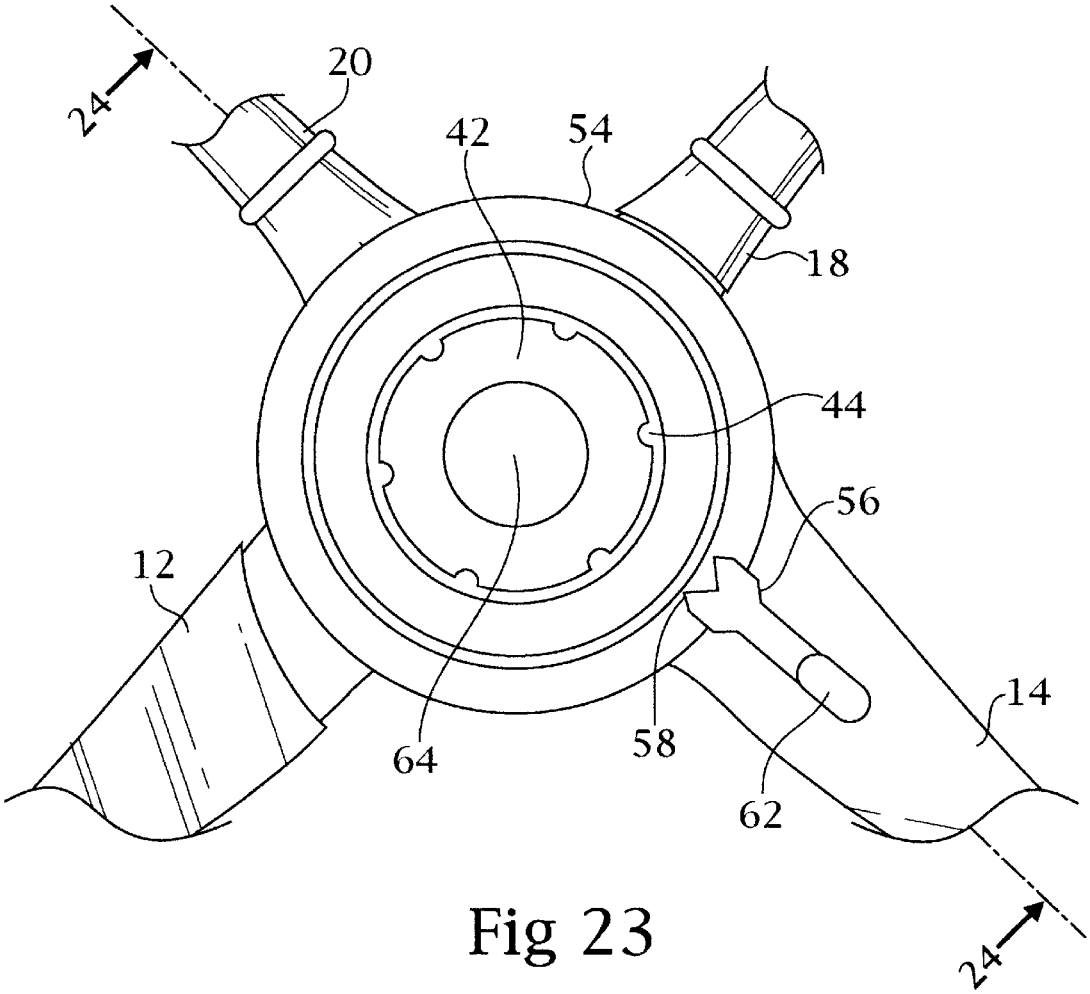
FIG. 23 is a partial cutaway top plan view of the ratcheting in the hub of the specialty tool.
Figure 24:
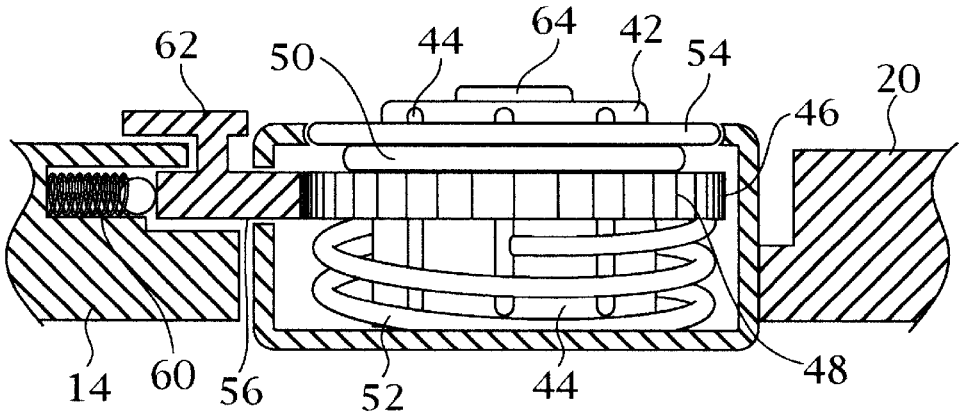
FIG. 24 is a cross-sectional view taken across the lines 24—24 of FIG. 23.

One embodiment of the ratcheting means is shown in FIGS. 23 and 24. A center post 42 is formed as part of one of the handles 12, 14. The center post 42 has a plurality of spaced-apart grooves 44 formed therein. A floating drive gear 46 having a plurality of inwardly oriented spokes is disposed around the center post 42 such that the spokes are engaged in the grooves 44 in the center post 42. The drive gear 46 has a plurality of teeth formed circumferentially thereon. An inner lock ring 50 is disposed over the drive gear 46 and around the center post 42 to retain the drive gear 46. A tension spring 52 is disposed around the center post 42 beneath the drive gear 46 to urge the drive gear 46 against the inner lock ring 50. A cover plate 54 which serves as an outer lock ring is disposed over the drive gear 46 and also holds the first handle 12 and the second handle 14 in position preventing separation of the handles at the pivot point.

A bore is formed in the one of the handles 12, 14 juxtapositioned to the hub. In the bore is disposed a pawl 56 having a pair of teeth 58. The teeth 58 engage the drive gear teeth 48. A spring and ball detent means 60 is disposed in the bore distal from the hub 16 to urge the teeth 58 of the pawl 56 into engagement with the drive gear teeth 48. A releasing lever 62 is connected to the pawl 56 so that the specialty tool, when grasping a workpiece, at the option of the user, can be readily disconnected.

Thus, the specialty tool 10 is used to grasp a workpiece. As pressure is applied to the handles 12, 14 by the user, the jaw members 22, 24 more firmly grasp the workpiece and jaw members 22, 24 are locked on the workpiece by the ratcheting means. Additional pressure on the handles 12, 14 advances the pawl teeth 58 on the is drive gear teeth 48 to tighten the locking. In this manner, the locking of the jaw members 22, 24 is selectively controlled at the option of the user. When the specialty tool 10 is locked on the workpiece, the user may release his/her grasp on the handles 12, 14 and the specialty tool 10 will continue to hold the workpiece. The specialty tool 10 is quickly and easily unlocked and released from the workpiece by movement of the releasing lever 62.

The ratcheting means further may have a quick release means 64 such as a button disposed on top of the cover plate 54. The button has a stem disposed in an axial opening in the center post 42 to contact the spokes on the drive gear 46. Pressure on the quick release means 64 forces the drive gear 46 downwardly against the urging of the tension spring 52 to disengage the pawl 56 from the drive gear 46.

Figure 25:
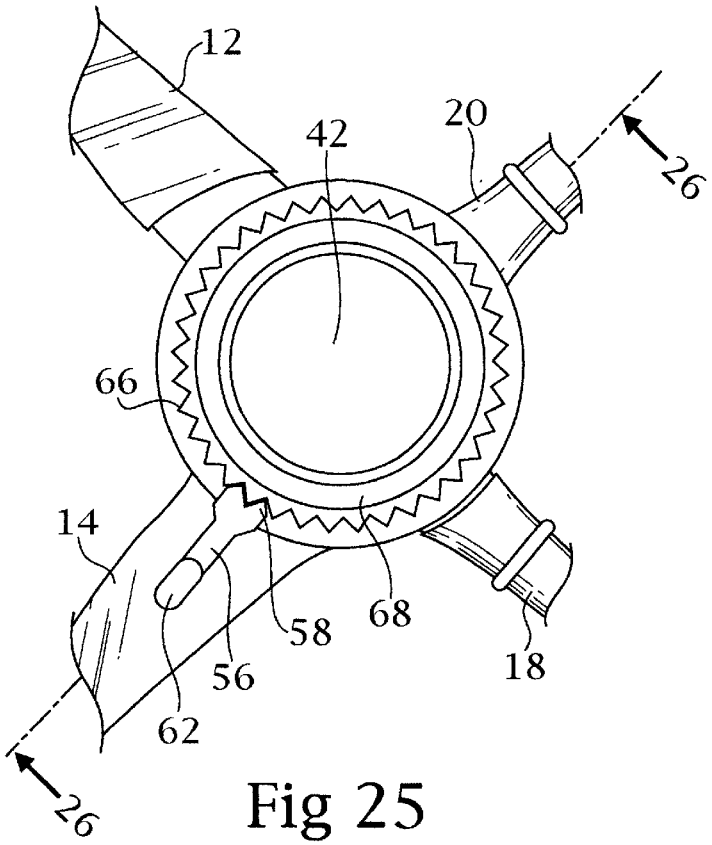
FIG. 25 is a partial cutaway top plan view of another embodiment of the ratcheting means in the hub of the specialty tool.
Figure 26:
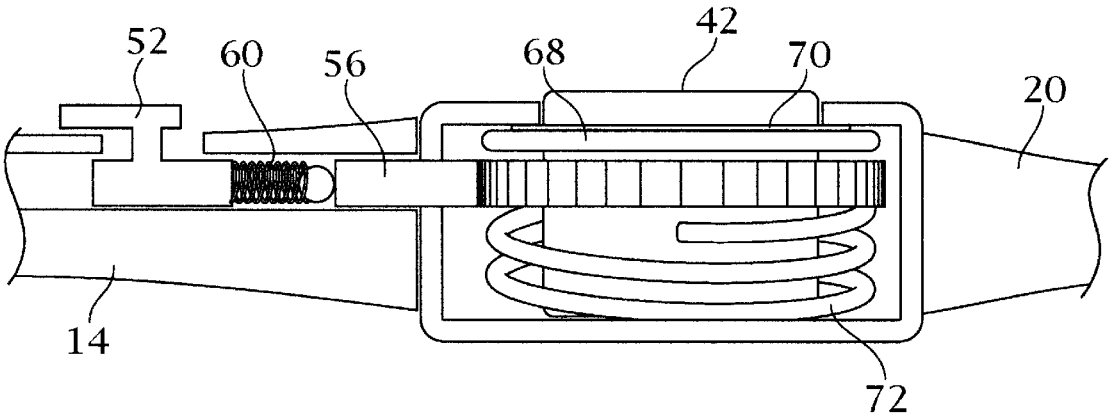
FIG. 26 is a cross-sectional view taken across the lines 26—26 of FIG. 25.

A second embodiment of the ratcheting means is shown in FIGS. 25 and 26. A center post 42 is formed as part of one of the handles 12, 14. The center post 42 has a plurality of spaced-apart teeth 66 formed thereon. The teeth 66 extend around approximately 180° of the center post and are proximal to the handles 12, 14 and distal from the studs 18, 20. A top plate 68 is disposed near the top of the center post 42. A retaining ring 70 is disposed over the top plate 68 to hold the top plate 68 in place and to secure the handles 12, 14 of the pliers 10 from separating. A spring means 72 is disposed near the base of the center post 42 engaging both handles 12, 14 and urging the handles 12, 14 into an opened position so that the jaw members 22, 24 are normally spaced apart to receive the workpiece.

A bore is formed in one of the handles 12, 14 juxtapositioned to the hub 16. In the bore is disposed a pawl 56 having a pair of teeth 58. A spring and ball detent means 60 is disposed in the bore to urge the teeth of the pawl 58 into engagement with the teeth 66 on the center post 42. A releasing lever 62 is connected to the pawl 56. Pulling the releasing lever 62 away from the hub 16 disconnects the pawl teeth 58 from the teeth 66 on the center post 42 so that, at the option of the user, the ratcheting means may be disconnected and the jaw members unlocked from the workpiece.

As seen in FIGS. 1, 3, 24 and 26, the present specialty tool has a low profile and is able to be used in confined spaces.

Obviously, many modifications may be made without departing from the basic spirit of the present invention.

Accordingly, it will be appreciated by those skilled in the art that within the scope of the appended claims, the invention may be practiced other than has been specifically described herein.

What is claimed is:

1. A specialty tool comprising:

a first handle and a second handle, a first jaw member attached to the first handle, a second jaw member attached to the second handle, the handles pivotably joined within a hub, one of the handles having a center post formed thereon, the center post having engaging means formed thereon, a ratcheting means formed within the hub, the ratcheting means having a drive gear having a center opening, the center opening receiving therein the center post and the engaging means, the drive gear having circumferential teeth thereabout, a toothed pawl being disposed in the first handle, wherein the teeth on the pawl engage the teeth on the drive gear, and wherein the specialty tool has optional ratcheting locking of the jaws at the selection of a user.

2. The specialty tool of claim 1, wherein the first jaw member is removable.

3. The specialty tool of claim 1, wherein the second jaw member is removable.

4. The specialty tool of claim 1, wherein the first and second jaw members are removably retained on the respective handles by a twist lock means.

5. The specialty tool of claim 4, further comprising an elastomeric seal formed on each handle adjoining the respective first and second jaw members to reduce wobble of said jaw members.

6. The specialty tool of claim 1, wherein the first jaw member and the second jaw member each comprise a plurality of removable jaw members defining a plurality of pairs of opposing jaw members, each respective pair of opposing jaw members adapting the specialty tools for specific desired uses.

7. The specialty tool of claim 6, further comprising an elastomeric seal formed on each handle adjoining the respective first and second jaw members to reduce wobble of said jaw members.

8. The specialty tool claim 1, further comprising a releasing lever mounted in one of the handles connected to the pawl in the ratcheting means to release the specialty tool from the locked positioned.

9. The specialty tool of claim 1, wherein a locking ring is disposed over the drive gear, a tension spring disposed under the drive gear, the tension spring urging the drive gear against the lock ring to retain the drive gear.

10. A specialty tool comprising:

a first handle and a second handle pivotably within a hub, one of the handles having a center post formed therein, the center post having engaging means, a ratcheting means having a drive gear having a center opening, the center opening receiving therein the center post and engaging means, the drive gear having circumferential teeth thereabout disposed within the hub, a pawl having teeth to engage the teeth on the drive gear, the pawl being disposed in the first handle, each handle having a respective stud extending outwardly from the hub, a pin being formed on each stud, the respective pins being perpendicular to a center line of each stud, a first jaw member and a second jaw member, each jaw member having a respective first end and a respective second end, the first ends each having a work surface and the second ends being an engagement tip, each engagement tip having an axial bore formed therein, an L-shaped slot being formed in each axial bore, each L-shaped slot being formed in each axial bore, each L-shaped slot having a leg and a base, the base being disposed interiorly of the axial bore, wherein the respective stud is received in the bore in the respective engagement tip with the pin received in the leg of the L-shaped slot and when the respective jaw member is twisted the pin is received in the base of the L-shaped slot such that the respective jaw members are removably locked on the respective studs.

11. The specialty tool of claim 10, further comprising the ratcheting means being locking.

12. The specialty tool of claim 11, further comprising a releasing lever connected to the locking ratcheting means.

13. The specialty tool claim 10, further comprising an elastomeric seal formed on each stud, the respective elastomeric seals contacting the respective engagement tips of the respective first and second jaw members when the jaw members are mounted on the studs wherein wobble of the jaw members is reduced.

14. A specialty tool having a pair of handles pivotally joined within a hub in a pair-like manner, the specialty tool comprising replaceable jaws connected to the handles, a ratcheting means disposed within the hub for optional ratcheting of the specialty tool, the ratcheting means having a drive gear, a tension spring disposed under the drive gear and a locking ring disposed over the drive gear, the tension spring urging the drive gear against the lock ring, to retain the drive gear, and a releasing means connected to the ratcheting means.

* * * * *